US006860032B2

(12) United States Patent
Meyer

(10) Patent No.: US 6,860,032 B2
(45) Date of Patent: Mar. 1, 2005

(54) STATIONARY CLOTHES DRYING APPARATUS WITH JET NOZZLES

(75) Inventor: Robert W. Meyer, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/341,719

(22) Filed: Jan. 14, 2003

(65) Prior Publication Data

US 2004/0134088 A1 Jul. 15, 2004

(51) Int. Cl.[7] ..... F26B 19/00
(52) U.S. Cl. ..... 34/225; 34/224; 34/202
(58) Field of Search ..... 34/443, 464, 465, 34/619, 654, 174, 192, 582, 202, 224, 225, 603, 604, 230, 90, 103, 104

(56) References Cited

U.S. PATENT DOCUMENTS

| | | | | | |
|---|---|---|---|---|---|
| 11,460 | A | * | 8/1854 | Proctor | 172/722 |
| 502,237 | A | * | 7/1893 | Proctor | 312/301 |
| 805,935 | A | * | 11/1905 | Schwartz | 34/196 |
| 1,013,042 | A | * | 12/1911 | Mossop | 223/75 |
| 3,074,179 | A | * | 1/1963 | Stelling, Jr. | 34/654 |
| 3,501,846 | A | * | 3/1970 | Melega | 34/103 |
| 3,501,847 | A | * | 3/1970 | Sanford et al. | 34/103 |
| 4,471,537 | A | * | 9/1984 | Meda | 34/77 |
| 4,682,424 | A | * | 7/1987 | Irving | 34/621 |
| 4,750,276 | A | * | 6/1988 | Smith et al. | 34/612 |
| 5,152,077 | A | * | 10/1992 | Liang | 34/77 |
| 5,555,640 | A | * | 9/1996 | Ou | 34/202 |
| 5,666,743 | A | * | 9/1997 | Dawson | 34/219 |
| 5,755,040 | A | * | 5/1998 | Ou | 34/202 |
| 5,870,836 | A | | 2/1999 | Grimes | 34/202 |
| 6,018,886 | A | * | 2/2000 | Bell et al. | 34/380 |

FOREIGN PATENT DOCUMENTS

| | | | |
|---|---|---|---|
| DE | 472 119 | 2/1929 | |
| DE | 838 888 | 5/1952 | |
| DE | 100 65 336 | 7/2002 | D06F/25/00 |
| EP | 658 646 | 6/1995 | D06F/58/14 |
| EP | 933 465 | 2/1999 | D06F/58/10 |
| GB | 958 361 | 5/1964 | |
| GB | 958 363 | 5/1964 | |

OTHER PUBLICATIONS

European Search Report EP03028871, Feb. 9, 2004.

* cited by examiner

*Primary Examiner*—Kenneth Rinehart
(74) *Attorney, Agent, or Firm*—Robert O. Rice; John F. Colligan; Stephen Krefman

(57) ABSTRACT

A stationary dryer, useful as a clothes dryer, is provided comprising a housing enclosing a space and a stationary clothes support located within the space. An air moving device is provided for generating an air flow through the space from an air inlet to an air outlet. An air distributor mechanism comprising a distribution plenum is positioned between the air inlet and the clothes support, with a plenum wall having a plurality of perforations therein. The perforations are sized, shaped and arranged so as to provide jets of air against the clothes support and to equalize an air flow distribution over the clothes support.

22 Claims, 2 Drawing Sheets

STATIONARY CLOTHES DRYING APPARATUS WITH JET NOZZLES

BACKGROUND OF THE INVENTION

The present invention relates to stationary drying, such as for clothes drying, and particularly to a stationary drying apparatus including an air flow directed against the clothes to be dried.

Significant percentages of items that are washed are not dried in a tumble dryer. Estimates of percentages are as high as 40%. These items are typically dried hanging in ambient air or, if the danger of stretching exists, dried laying flat in ambient air. When drying in this manner, free convection is the primary mechanism of heat transfer. Free convection also carries away evaporated water in support of the necessary mass transfer.

Drying rates can be doubled or tripled in comparison to free convection when common fans or blowers are used to provide conventional parallel flow forced convection heat transfer. Heat transfer rates may also be greatly increased for conventional forced convection, however fan/blower cost will typically rise exponentially with increased heat transfer rate.

For some fabrics, drying, while initially fast, may become slower later in the drying cycle due to the need to break mechanical and chemical bonds that limit the amount of "free" water available for evaporation. Normally this binding is more easily broken as temperatures are elevated.

Drying devices have been built in the past in which items may be placed to dry in a forced convection air stream that is typically heated. For example, EP 0 933 465 discloses a stationary clothes dryer having a perforated plate for receiving a layer of clothing articles to be dried, through which a flow of heated air is directed. These drying devices include stationary supports as well as movable drawers. For example U.S. Pat. No. 5,870,836 discloses the use of porous shelf inserts that slide in horizontal slots. These devices have been effective in reducing the drying time in comparison to ambient drying, however, these designs have not reached their highest potential effectiveness. The primary reason that limitations exist in the prior art designs is the limited consideration that has been given to optimum heat transfer and air flow design. In some designs, air flow is diverted by one item to be dried such that drying of other items is effectively blocked.

SUMMARY OF THE INVENTION

The present invention provides for improved performance in stationary drying devices through the use of jet impingement to increase the heat transfer rate (such as by double) in comparison to conventional parallel flow convection for the same fan/blower capacity. The present invention provides enhanced and uniform heat transfer which improves the free water evaporation rate. The present invention provides arrangements for both hanging and laying objects so that air flow is effective for both types of items.

The thermal boundary layer developed in conventional parallel flow convection resists heat and mass transfer. Jet impingement significantly reduces the boundary layer near the jet and increases the overall heat and mass transfer rate. In addition, where conventional parallel flow convection for drying occurs over a significant length, mass transfer becomes limited due to higher water vapor concentrations in the bulk flow. In the case of jet impingement, flow of equal capacity for evaporation can be provided over a large area of the object being dried. Although the spent flow in the case of jet impingement may be limited in water vapor capacity, lateral transfer of water within the fabric will usually minimize the spent flow effect.

In an embodiment of the invention, a stationary clothes dryer is provided which comprises a housing enclosing a space and a clothes support located within the space. The clothes support remains stationary during the drying operation, but may be movable, such as a drawer, to increase the ease of introducing and removing clothing articles to be dried. An air moving device is also provided for generating an air flow through the space from an air inlet to an air outlet. An air distributor mechanism is provided which comprises a distribution plenum positioned between the air inlet and the clothes support, with a plenum wall having a plurality of perforations or nozzles therein, the perforations/nozzles being sized, shaped and arranged so as to provide jets of air against the clothes support and to equalize an air flow distribution over said clothes support.

DETAILED DESCRIPTION OF THE PREFERRED EMBODIMENTS

A stationary dryer incorporating the principles of the present invention can be practiced in many different embodiments. Some of these embodiments are shown and described herein, however, the present invention is not limited to the particular embodiments contained in this description.

The term stationary dryer is meant to cover drying devices in which the articles to be dried remain relatively stationary during the drying process. The dryer itself may be movable to different locations and various components of the dryer may be movable, particularly when the articles to be dried are being placed into or removed from the dryer. While such a device could be used to dry a wide variety of articles, for the purposes of providing an enabling disclosure of the best mode of the invention, embodiments are described below for drying clothing or other fabric articles, however, the invention is not limited to such specific uses.

Figure 1:
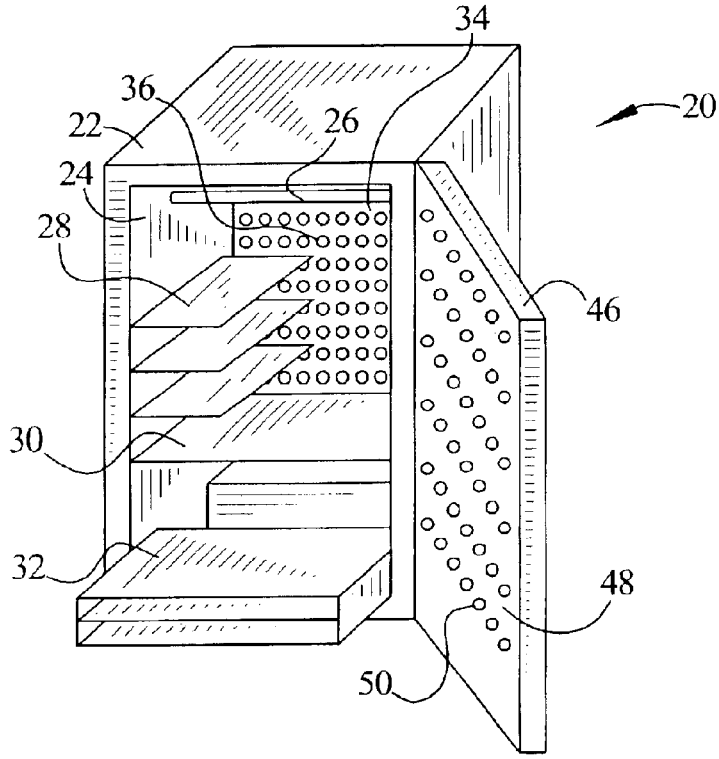
FIG. 1 is a perspective view of a stationary clothes dryer positioned within a drying cabinet and embodying the principles of the present invention.

In FIG. 1 a stationary dryer which may be useful for drying clothes is illustrated generally at 20 which comprises a housing 22 enclosing a space 24. A plurality of different types of clothes supports are illustrated as being located within the space 24. A first clothes support device comprises a hanger bar 26 which extends across the width of the space to receive hangers for supporting clothing articles. A second type of clothes support comprises a half width shelf 28, of which there are three illustrated in FIG. 1 positioned one above the other. A third type of clothes support is a full width shelf 30. The half width shelves 28 and the full width shelf 30 may be solid shelves or may be perforated or open support shelves.

A fourth type of clothes support, and one in which the principles of the present invention are utilized, is referenced at 32 which may be used and positioned in the housing 22 or may be used independently, as described below with respect to FIGS. 3 and 4 where this clothes support/dryer will be described in more detail.

The space 24 in the housing 22 is defined at a rear side by a rear wall 34 which, as shown in FIG. 1, is provided with a plurality of perforations 36. These perforations are sized, shaped and arranged so as to provide a flow of air through the interior space 24.

Figure 2:
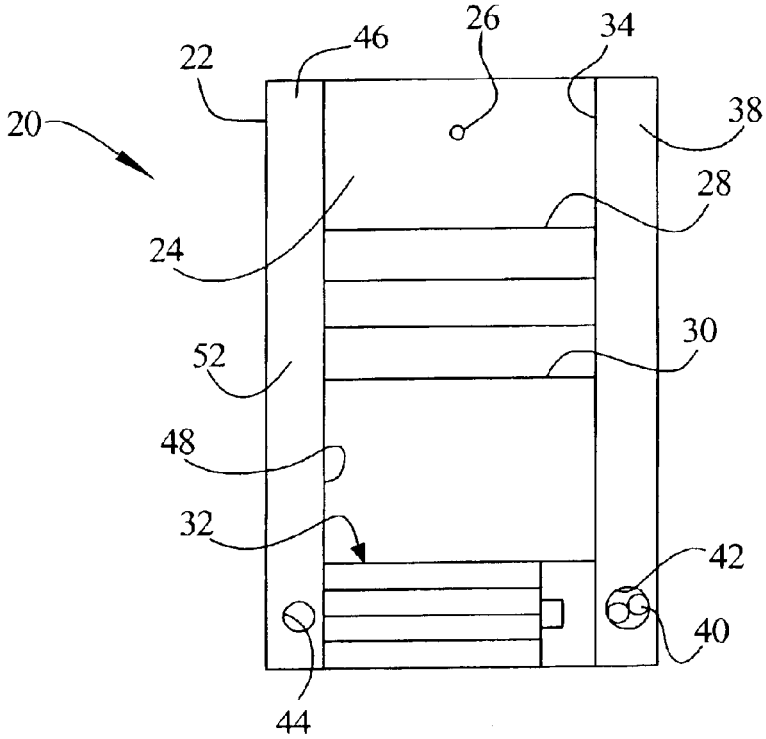
FIG. 2 is a side sectional view of the clothes dryer of FIG. 1.

As shown in FIG. 2, behind the rear wall 34 is an air distribution plenum 38. An air moving device 40 is provided which generates an air flow through the space 24 from an air inlet 42 to an air outlet 44. A heating element may be provided to elevate the temperature of the air in the air flow stream.

The air outlet 44 is located in a door 46 of the housing 22. The door includes an interior wall 48 which is provided with a plurality of exhaust outlet perforations 50 through which air flows into an exhaust plenum 52 which leads to the air outlet 44. Thus, upon operation of the fan 40, air is drawn in through the inlet 42, pushed through the distribution plenum 38 (while optionally being heated) and the perforations 36 into the space 24 where the air flows across the clothes supports 26, 28, 30. The air then exits the space 24 through the perforations 50 in the door 46 to flow into the exhaust plenum 52 and out through the air outlet 44. The clothes supports 28 and 30 comprise flat surfaces which lie in a plane parallel to the air flow through the space 24. The clothes supports 28, 30 may be fixed in place in the space 24 or they may be arranged on a movable slide member allowing the support to be slid into and out of the housing to load and unload clothing items on the support.

Figure 3:
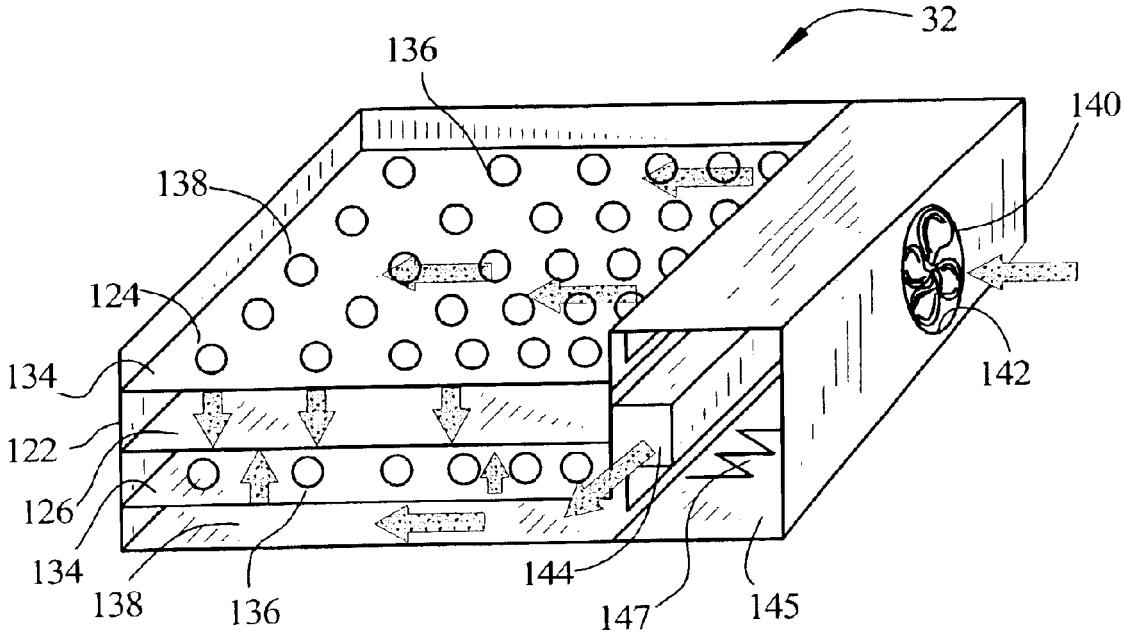
FIG. 3 is a perspective schematic view of a stationary clothes dryer.
Figure 4:
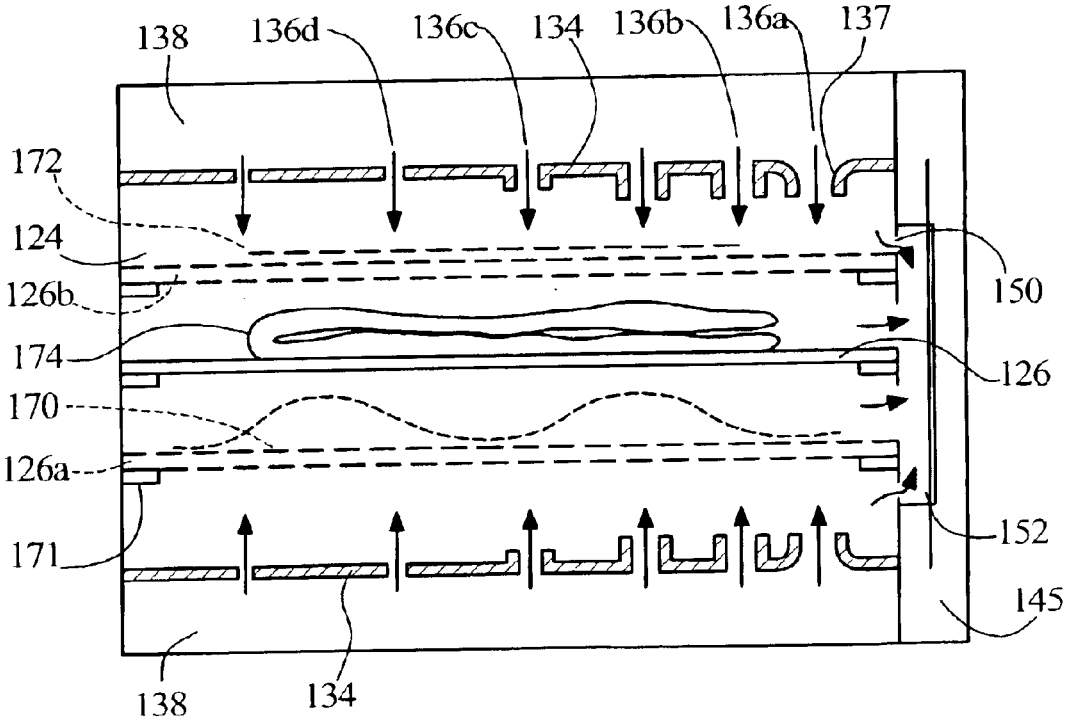
FIG. 4 is a side view of the stationary clothes dryer of FIG. 3.

The clothes support/clothes dryer 32 embodying the principles of the present invention, is shown in greater detail in FIGS. 3 and 4. As mentioned above, this clothes support 32 can function in conjunction with the stationary clothes dryer 20 and therefore can be located in the space 24 of the clothes dryer 20 of FIGS. 1 and 2, or can be mounted separately and can function itself as an independent clothes dryer in that it has a housing 122 enclosing an interior space 124 which comprises a drying chamber. In this clothes support/clothes dryer 32, plenums and jet nozzle designs provide for uniformity of jet impingement heat transfer over the object being dried. There is a clothes support 126 located within the space 124 which may comprise a substantially horizontal surface, which, in a preferred embodiment, is a porous surface, such as netting or screening, or may be a solid plate with perforations therethrough. The term porous is meant to include any surface through which air is permitted to pass and may have significant open areas. Alternatively, the entire housing 122 could be rotated 90° about a horizontal axis so that the clothes support 126 is reconfigured and arranged vertically, such as a hanger for hanging clothes. An air moving device 140, which may be in the form of a fan, is used for generating an air flow through the space 124 from an air inlet 142 to an air outlet 144. If this device is used with the clothes dryer 20 of FIGS. 1 and 2, the air moving device and air inlet can be those shown at 40 and 42 in those figures. Although the fan 140 is shown as being located in the air inlet, and thus pushes air through the clothes dryer 32, it could also be associated with the air outlet 144 to draw air through the clothes dryer.

An air distributor mechanism is provided which may comprise two distribution plenums, one positioned above and one positioned below the horizontal support surface 126 (or one in front and one behind if the support surface is vertical). These distribution plenums 138 communicate with a supply plenum 145 which extends between the air inlet 142 and the distribution plenums 138. A heating element 147 may be provided in one or more of the plenums to elevate the temperature of air that is caused to flow through the clothes drying device.

Each distribution plenum 138 is provided with a distribution plenum wall 134, and the plenum walls each have a plurality of perforations 136 (comprising holes or nozzle openings) therein. The perforations can be round, oval, square, rectangular, slot-shaped, curved or configured in other shapes as desired to provide the desired air flow. The perforations 136 are sized, shaped and arranged so as to provide jets of air substantially perpendicular to and against the clothes support 126 and to equalize an air flow distribution and uniform heat transfer coefficient over the clothes support 126. Although a preferred arrangement has the jets impinging on the article to be dried substantially perpendicularly, the jets could also be directed at the article at various angles. Air flow from the perforations 136 essentially parallel to the article surface, however, is not desired in accordance with the present invention. The perforations 136 may in fact comprise elongated passages, as shown in FIG. 4, particularly where the diameter of the openings is greater than a thickness of the plenum wall. If a relatively small hole is used for the perforation (such as orifice **136*d***), the thickness of the plenum wall may be sufficient, however, if the hole has a larger diameter, the hole length should be as large as, or greater, than the diameter in order to maintain an optimized jet impinging on the object to be dried.

The nozzle location, diameter and distance to target are designed to achieve uniform heat transfer. Jet impingement design is normally based on the prediction of localized heat transfer coefficients or coefficients that represent an average over the target area. These values, local and averaged, vary due to the effect of spent flow, that is, the exhausting gas from other jets.

It can be noted in FIG. 4 that a nozzle **136*a* near an exhaust outlet 150 of the drying chamber 124 is of different shape than the other holes or nozzles 136. This nozzle 136*a* is designed to vary its restrictive effect in comparison to other nozzles. By changing the restrictive effect of this nozzle, or the number and placement of such nozzles, the flow can be brought into balance for all nozzles. This particular nozzle 136*a* has a tapered entry opening 137. This lessens the restriction to flow in comparison to the sharp edge inlet on the nozzles 136*b*, just to its left in FIG. 4. It is desirable to be able to vary the restriction to flow by such methods as size (hole diameter), density (the number of holes per a given area), or as shown with the nozzle 136*a*, by creating a variation of the entry restriction. As shown in FIG. 4, the nozzles 136*d* at the far left are smaller in diameter, and spaced further from each other, than the nozzles 136*c* just to their right. The diameter and length of the nozzles 136*c* are smaller than the diameter and length of the nozzles 136*b* just to their right. The space between adjacent nozzles 136*b* is less than the space between adjacent nozzles 186*c*. Preferably the sizing, configuration and placement of the nozzles 136 in the lower plenum wall 134** is identical to that in the upper plenum wall. Uniform nozzles uniformly distributed would not have provided for uniform flow in this configuration.

It would be possible to provide venting from three sides of the drying chamber 126 in an attempt to minimize the effect of spent flow. However, this would reduce the area available for drying and would increase manufacturing complexity and cost. The clothes support 126 thus comprises a flat surface lying in a plane generally perpendicular to the air flow through the space 124 in the area of the support. The porous surface 126 may be mounted on a movable slide member allowing the surface to be slid into and out of the housing 122 or the upper plenum wall 134 may be pivotally mounted to provide access to the surface 126 for loading and unloading clothes articles onto the surface.

In operation, the fan 140 causes air to flow in through the air inlet 142 to the supply plenum 145 and from there into the distribution plenums 138 where the air will flow through the nozzle perforations 136 to impinge against the article to be dried supported by the porous surface 126. The air will then flow through the exhaust outlet 150 into an exhaust plenum 152 and out through the air outlet opening 144.

In an embodiment, the clothes support 126 can be placed in different locations relative to the plenum walls 134. This makes possible adjustment of position of the object to be dried from the jet nozzle 136 to provide uniform top and bottom heating. In the case of relatively thin material of varying shape, such as a bra 170, the support 126 may be mounted on a slide member and slid onto a rail 171 to its bottom position (shown in phantom at 126*a*) to provide reasonably uniform nozzle to target distance. In the case of a thin item, such as a silk garment 172, the top (and centered) position (shown in phantom at 126*b*) provides uniform top and bottom heating. In the case of a thick but uniform object, such as a folded blanket 174, the middle position (shown in full lines at 126) could be used. It should be realized that the number of positions need not be restricted to three, and could be greater, and could be less, including only a single position.

In the embodiment illustrated, a heater 147 is used to increase the rate of evaporation. Another mode of operation would be with a fan 142 only. The drying time will be longer without a heater, but the cost of operation lower. It would be possible to produce different embodiments of the invention in different configurations, such as without heaters, or with nozzles of different configurations or with different numbers of positions for the clothes support 126. The key feature is the use of jet impingement and varying flow restriction of the nozzles/openings from the plenum chamber 138 to the drying chamber 124 that develop essentially uniform flow and heat transfer over the material being dried.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A stationary dryer comprising:

a housing enclosing a space, at least one stationary article support located within said space for supporting said article in a horizontal plane, an air moving device for generating an air flow through said space from an air inlet to an air outlet, an air distributor mechanism comprising a distribution plenum positioned between said air inlet and said stationary article support, with a plenum wall having a plurality of perforations therein, said perforations being sized and shaped so as to provide jets of air at an angle other than essentially parallel to said plane against two opposite sides of said article support and to equalize an air flow distribution over said article support, wherein said perforations vary in at least one of shape and size throughout said plenum wall.

2. A stationary dryer according to claim 1, wherein said air distributor mechanism comprises a supply plenum arranged between said air inlet and said distribution plenum to direct said air flow from said air inlet to said distribution plenum.

3. A stationary dryer according to claim 1, wherein said plenum wall of said distribution plenum extends above and below said article support, such that said air flow is introduced both above and below said article support by said distribution plenum.

4. A stationary dryer according to claim 1, wherein said housing is located within a space enclosed by a housing of another stationary dryer.

5. A stationary dryer according to claim 1, wherein said stationary article support is mounted on a movable slide member allowing said support to be slid into and out of said housing to load and unload articles on said support.

6. A stationary dryer comprising:

a housing enclosing a space, at least one stationary article support located within said space for supporting said article in a horizontal plane, an air moving device for generating an air flow through said space from an air inlet to an air outlet, an air distributor mechanism comprising a distribution plenum positioned between said air inlet and said stationary article support, with a plenum wall having a plurality of perforations therein, said perforations being sized, shaped and arranged so as to provide jets of air at an angle other than essentially parallel to said plane against two opposite sides of said article support and to equalize an air flow distribution over said article support, wherein said perforations vary in at least one of configuration, and size throughout said plenum wall, and wherein said stationary article support comprises a horizontal porous surface.

7. A stationary dryer according to claim 6, wherein said air distribution mechanism comprises a first distribution plenum positioned over said porous surface and a second distribution plenum positioned beneath said porous surface, each with a plenum wall having a said plurality of perforations therein.

8. A stationary dryer comprising:

a housing enclosing a space, at least one stationary article support located within said space for supporting said article in a horizontal plane, an air moving device for generating an air flow through said space from an air inlet to an air outlet, an air distributor mechanism comprising a distribution plenum positioned between said air inlet and said stationary article support, with a plenum wall having a plurality of perforations therein, said perforations being sized, shaped and arranged so as to provide jets of air at an angle other than essentially parallel to said plane against two opposite sides of said article support and to equalize an air flow distribution over said article support, wherein said perforations vary in at least one of configuration, and size throughout said plenum wall, and wherein said perforations comprise nozzles having a length greater than a thickness of said plenum wall.

9. A stationary dryer comprising:

a housing enclosing a space, at least one stationary article support located within said space for supporting said article in a horizontal plane, an air moving device for generating an air flow through said space from an air inlet to an air outlet, an air distributor mechanism comprising a distribution plenum positioned between said air inlet and said stationary article support, with a plenum wall having a plurality of perforations therein, said perforations being sized, shaped and arranged so as to provide jets of air at an angle other than essentially parallel to said plane against two opposite sides of said article support and to equalize an air flow distribution over said article support, wherein said perforations vary in at least one of configuration, and size throughout said plenum wall, and wherein said article support comprises a flat surface lying in a plane substantially perpendicular to an air flow from said perforations through said space adjacent to said article support.

10. A stationary clothes dryer comprising:

a housing enclosing a space, a stationary clothes support located within said space comprising a substantially horizontal porous surface, an air moving device for generating an air flow through said space from an air inlet to an air outlet, an air distributor mechanism comprising a first distribution plenum positioned over said porous surface and a second distribution plenum positioned beneath said porous surface, each with a plenum wall having a plurality of nozzle openings therein, said nozzles in each plenum wall being sized, shaped and arranged so as to provide jets of air against said clothes support in a non-horizontal direction and to equalize an air flow distribution over and through said clothes support.

11. A stationary clothes dryer according to claim 10, wherein said horizontal porous surface is mounted on a movable slide member allowing said surface to be slid into and out of said housing to load and unload clothing items on said surface.

12. A stationary clothes dryer according to claim 10, wherein said air distributor mechanism comprises a supply plenum arranged between said air inlet and said distribution plenums to direct said air flow from said air inlet to said distribution plenums.

13. A stationary clothes dryer according to claim 10, wherein said housing is located within a space enclosed by a housing of another stationary dryer.

14. A stationary clothes dryer according to claim 10, wherein said perforations comprise nozzles having a length greater than a thickness of said plenum wall.

15. A stationary clothes dryer according to claim 14, wherein said nozzles vary in at least one of configuration, spacing and size throughout said plenum wall.

16. A stationary clothes dryer according to claim 14, wherein said nozzles are configured and arranged such that said jets of air are directed substantially perpendicular to said clothes support.

17. A stationary clothes dryer comprising:

a housing enclosing a space, a clothes support located within said space comprising a substantially horizontal porous surface, a fan for generating an air flow through said space from an air inlet to an air outlet, an air distributor mechanism comprising a supply plenum leading from said air inlet to a distribution plenum positioned between said supply plenum and said horizontal porous surface, said distribution plenum comprising a pair of spaces, one located on each vertical side of said horizontal porous surface, a distribution plenum wall extending above and a distribution plenum wall extending below said horizontal porous surface and each having a plurality of perforations therein, said perforations being sized, shaped and arranged so as to provide jets of air to impinge substantially perpendicularly both down and up against said clothes support and to equalize an air flow distribution over and through said clothes support.

18. A stationary clothes dryer according to claim 17, wherein said horizontal porous surface is mounted on a movable slide member allowing said surface to be slid into and out of said housing to load and unload clothing items on said surface.

19. A stationary clothes dryer according to claim 17, wherein said perforations vary in at least one of configuration, spacing and size throughout said plenum wall.

20. A stationary dryer comprising:

a housing enclosing a space, at least one stationary article support located within said space, an air moving device for generating an air flow through said space from an air inlet to an air outlet, an air distributor mechanism comprising a distribution plenum positioned between said air inlet and said stationary article support, with a plenum wall having a plurality of perforations therein, said perforations comprise a plurality of nozzles having a length greater than a thickness of said plenum wall, said nozzles being arranged so as to provide jets of air at an angle other than essentially parallel against said article support, said plurality of nozzles having various different configurations across said plenum wall to equalize an air flow distribution over said article support.

21. A stationary clothes dryer according to claim 20, wherein said different configurations of said nozzles comprise different diameters.

22. A stationary clothes dryer according to claim 20, wherein said different configurations of said nozzles comprise different lengths.

* * * * *